US006210275B1

(12) United States Patent
Olsen

(10) Patent No.: US 6,210,275 B1
(45) Date of Patent: Apr. 3, 2001

(54) PROGRESSIVE JACKPOT GAME WITH GUARANTEED WINNER

(75) Inventor: Eric Burton Olsen, Henderson, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 0 days.

(21) Appl. No.: 09/318,891

(22) Filed: May 26, 1999

Related U.S. Application Data

(60) Provisional application No. 60/086,676, filed on May 26, 1998.

(51) Int. Cl.[7] ..... A63F 9/24

(52) U.S. Cl. ..... 463/16; 463/6; 463/27; 273/138.1; 273/143 R

(58) Field of Search ..... 463/21–25, 27, 463/16, 18, 42, 6; 273/143 R, 138.1, 309

(56) References Cited

U.S. PATENT DOCUMENTS

| | | |
|---|---|---|
| 3,810,627 | 5/1974 | Levy . |
| 4,258,838 | 3/1981 | Rockola et al. . |
| 4,283,709 | 8/1981 | Lucero et al. . |
| 4,335,809 | 6/1982 | Wain . |

(List continued on next page.)

FOREIGN PATENT DOCUMENTS

| | | |
|---|---|---|
| 27572/84 | 11/1984 | (AU) . |
| 53370/86 | 8/1986 | (AU) . |
| 71194/91 | 8/1991 | (AU) . |
| 10488/92 | 7/1992 | (AU) . |
| 21070/92 | 10/1993 | (AU) . |
| 36472/95 | 5/1996 | (AU) . |
| 43615/97 | 5/1998 | (AU) . |
| 2 151 054 | 7/1985 | (GB) . |
| 2 201 279 | 8/1988 | (GB) . |
| 2 211 975 | 7/1989 | (GB) . |
| 406142274 | 5/1994 | (JP) . |
| WO 95/22811 | 8/1995 | (WO) . |
| WO 97/12338 | 4/1997 | (WO) . |
| WO 97/49073 | 12/1997 | (WO) . |

OTHER PUBLICATIONS

Scarne, Scarne's New Complete Guide to Gambling, 1974, pp. 39–41, Simon & Schuster, New York, New York.

"SuperLink, Premier Slot Merchandising System", Mikohn Winning Solutions . . . Worldwide, Mikohn Gaming Corporation, Las Vegas, NV.

John Acres, Gaming Innovations Concept III, circa Mar. 1993, 18 pages.

Form SB–2 Registration Statement Under the Securities Act of 1933, Sep. 20, 1993, 51 pages—Acres Gaming.

PCT International Search Report, Mar. 15, 1999, 3 pages.

*Primary Examiner*—Joe H. Chang
*Assistant Examiner*—Kathleen M. Christman
(74) *Attorney, Agent, or Firm*—Dorr, Carson, Sloan & Birney, P.C.

(57) ABSTRACT

The present invention relates to a progressive game that can be incorporated either as a bonus game or a stand-alone game in a progressive linked gaming machine environment. The game utilizes a plurality of progressive jackpot pools each associated with a particular game outcome (i.e., such as Quiniela, Exacta, Trifecta and Superfecta in the case of a horse race derby game). Each progressive jackpot pool is funded through play at the underlying linked game such as a contribution of each wager or through separate wagers. When the game of the present invention initiates, a plurality of successive game rounds are played. Each successive game round reduces the number of possible game outcomes such as by reducing the number of horses in each successive horse race. Therefore, with each successive game players have a higher probability of winning. The terminating round is reached in which the last game always results in at least one guaranteed winner through reduction of the possible game outcomes. However, a player (or players) may win in the first or any successive round which would immediately terminate the overall common game.

36 Claims, 6 Drawing Sheets

U.S. PATENT DOCUMENTS

| | | | | |
|---|---|---|---|---|
| 4,467,424 | | 8/1984 | Hedges et al. . | |
| 4,624,459 | | 11/1986 | Kaufman . | |
| 4,636,951 | | 1/1987 | Harlick . | |
| 4,652,998 | | 3/1987 | Koza et al. . | |
| 4,669,731 | | 6/1987 | Clarke . | |
| 4,679,143 | | 7/1987 | Hagiwara . | |
| 4,775,937 | | 10/1988 | Bell . | |
| 4,805,907 | | 2/1989 | Hagiwara . | |
| 4,837,728 | | 6/1989 | Barrie et al. . | |
| 4,844,462 | | 7/1989 | Lubniewski . | |
| 5,042,809 | | 8/1991 | Richardson . | |
| 5,048,833 | | 9/1991 | Lamle . | |
| 5,078,405 | | 1/1992 | Jones et al. . | |
| 5,116,055 | | 5/1992 | Tracy . | |
| 5,178,391 | * | 1/1993 | Okada | 273/143 R |
| 5,186,460 | | 2/1993 | Fongeallaz et al. . | |
| 5,217,224 | | 6/1993 | Sincock . | |
| 5,241,379 | | 8/1993 | Tsujita . | |
| 5,249,800 | | 10/1993 | Hilgendorf et al. . | |
| 5,257,179 | | 10/1993 | DeMar . | |
| 5,265,874 | | 11/1993 | Dickinson et al. . | |
| 5,275,400 | | 1/1994 | Weingardt et al. . | |
| 5,280,909 | | 1/1994 | Tracy . | |
| 5,326,104 | | 7/1994 | Pease et al. . | |
| 5,344,144 | | 9/1994 | Canon . | |
| 5,370,306 | | 12/1994 | Schulze et al. . | |
| 5,401,024 | | 3/1995 | Simunek . | |
| 5,411,258 | | 5/1995 | Wilson et al. . | |
| 5,429,361 | | 7/1995 | Raven et al. . | |
| 5,470,079 | | 11/1995 | LaStrange et al. . | |
| 5,472,194 | | 12/1995 | Breeding et al. . | |
| 5,511,781 | * | 4/1996 | Wood et al. | 463/25 |
| 5,560,601 | | 10/1996 | Yamazaki et al. . | |
| 5,564,700 | | 10/1996 | Celona . | |
| 5,564,701 | | 10/1996 | Dettor . | |
| 5,580,309 | | 12/1996 | Piechowiak et al. . | |
| 5,611,730 | | 3/1997 | Weiss . | |
| 5,626,341 | | 5/1997 | Jones et al. . | |
| 5,655,961 | | 8/1997 | Acres et al. . | |
| 5,664,998 | | 9/1997 | Seeling et al. . | |
| 5,766,074 | | 6/1998 | Cannon et al. . | |
| 5,833,537 | * | 11/1998 | Barrie | 463/21 |
| 5,855,515 | | 1/1999 | Pease et al. . | |
| 5,885,158 | | 3/1999 | Torango et al. . | |
| 6,113,493 | * | 9/2000 | Walker et al. | 463/25 |

* cited by examiner 300 330

Your Bonus Sweepstakes Tickets !

!!! ROUND 1 !!!

300 310 320 350 360

| | First buy-in | Second buy-in | Third buy-in | Pool Value |
|---|---|---|---|---|
| Quiniela | 3,6 | 1, 9 | 7, 3 | 24 credits |
| Exacta | 3,6 | 1, 9 | 7, 3 | 35 credits |
| Trifecta | 3- 6- 4 | 1- 9- 5 | 7- 3- 1 | $49.46 |
| Superfecta | 3- 6- 4- 8 | 1- 9- 5- 2 | 7- 3- 1- 8 | $900.75 |

Round 1 Race Results: 3 - 7 - 2 - 9

340

*Fig. 3*

PROGRESSIVE JACKPOT GAME WITH GUARANTEED WINNER

RELATED INVENTION

This application claims priority to provisional patent application, Ser. No. 60/086,676, filed May 26, 1998 and entitled "HORSE DERBY CAROUSEL BONUSING SYSTEM."

BACKGROUND OF THE INVENTION

1. Field of Invention

The present invention related to casino games, and, in particular, to a casino game using linked gaming machines interconnected to a progressive jackpot controller.

2. Statement of the Problem

A continuing need exists to provide new and exciting games and bonus in association with game play at linked gaming machines interconnected to a progressive jackpot controller.

Gaming machines are well known and include a variety of games such as slot, poker, and keno. Gaming machines can also be programmed to play a variety of games. Players insert monetary amounts by inserting coin, token, paper currency, magnetic card, or smart card; pushing credit buttons; or other suitable entry to play one or more games on a particular gaming machine. Such monetary amounts are usually translated into a number of units of the lowest unit of currency receivable by the machine, referred to herein as the unit bet. Such operation is well known in the art.

Upon entry of a monetary amount, the gaming machine determines therefrom which games and/or payoffs the player qualifies for based upon an internal game in the machine and on an associated internal pay table in the machine. The player is then normally required to take some action to institute playing of the game such as pushing a play button or pulling a lever arm. The player then plays the game according to the rules of the game. The player either wins the game or loses the game. If the player wins the game, the player is given the payoff established by the gaming machine for the particular game being played. This payoff varies considerably from type of game played to the type of winning combination in the rules of the game. Typically, the payoff is a return of monetary amounts equal to or in excess of the monetary amounts entered to play the game. Winning or losing the game completes the gaming cycle. If the player loses the game, the player typically loses the amount wagered and there is no payoff. The gaming machine then conditions itself so as to be able to again receive monetary amounts to begin another game cycle and the process repeats. Such individual stand-alone conventional gaming machines are found in numerous casinos throughout the world and are made by a number of different manufacturers. Conventional gaming machines include a variety of different slot machines (video or mechanical), poker, keno, etc.

In order to attract more players to such gaming machines, progressive gaming systems were developed. Progressive gaming systems permit the player to play individual gaming machines as discussed above. To add to the excitement of play, the individual gaming machines are linked together to allow players to compete for an additional common award or "progressive jackpot." The progressive jackpot award can amount to a substantial amount of money. Progressive gaming systems are also found in casinos throughout the world. In some environments, the progressive jackpot award is an expensive vehicle, such as a motorcycle or sports car.

In progressive gaming systems, a programmed controller is provided for linking the machines together. The controller receives the unit bets from the linked machines as well as machine identification information from each machine and supplies to the players, either through displays provided on their respective machines and/or a common overhead display, information as to the common progressive jackpot.

In one type of conventional progressive system, the controller controls the progressive game during each progressive game cycle by first establishing a jackpot-win amount in a random manner between maximum and minimum jackpot values. The controller has an internal random number generator for making this random selection. The controller also establishes a base value which is used as an initial amount for a current progressive jackpot amount, which is the progressive jackpot amount reported by the controller to the machine displays and/or the overhead display and display to the players. The current jackpot amount is recalculated or incremented by the controller each time a game is played at each gaming machine. The controller does this by adding to the current progressive jackpot amount an increment value based on the number of unit bets entered at the individual gaming machines in the progressive gaming system multiplied by a fixed progressive increment rate per unit bet. This is a continuous process since players at different machines are inserting monetary amounts to start game play at different times.

To this end, each gaming machine, as above indicated, reports its unit bet information to the controller or a communication link upon a player playing the gaming machine so that the current progressive jackpot value can be appropriately incremented. The gaming machine is also identified with conventional signaling to the controller with the bet information so that the controller knows which gaming machine resulted in the increment.

After each increment of the current progressive jackpot, the controller compares the new current jackpot value with the jackpot-win value, which it previously randomly established and stored. If the new value is less than a jackpot-win value, the controller merely updates the current jackpot value and communicates the updated value to the displays at the gaming machines and/or the overhead display. The controller then continues to monitor the unit bet information indicative of game play from the gaming machines and to increment the current progressive jackpot value based thereon.

When an increment to the current jackpot value causes the value to reach or become equal to the jackpot-win value, the controller determines that the jackpot has been won by the gaming machine, which resulted in the aforesaid increment. The controller communicates this to the winning gaming machine and the appropriate payment of the jackpot-win amount is made to the player. This suddenly surprises the player as it comes unexpectedly and adds excitement to the game.

After a jackpot has been won, the controller then institutes a new progressive game cycle in which it resets the progressive jackpot by randomly selecting, from values between the maximum and minimum jackpot values, a new jackpot-win value. The controller then also resets the current jackpot value to the base value and begins incrementing this value based on the fixed progressive increment. As before, this incrementing continues until the current jackpot value reaches the newly selected progressive jackpot-win value and the progressive jackpot is won again. The controller then repeats the progressive game cycle based on continued game play, as described above. The above type of linked random jackpot controller-based systems have been sold by Mikohn Gaming Corporation under the trademark MYSTERY JACKPOT and, for example, is discussed in U.S. Pat. No. 5,280,909. The '909 patent specifically teaches that the jackpot payout need not be a fixed jackpot-win value and that the award could be issued based upon conditions at the machine and paid when the next winning combination occurs at the machine. For example, the payout criteria might be to payout a jackpot equal to the award for the next winning combination established at the machine.

A need exists to improve upon progressive gaming systems, to attract players, to retain players at the gaming machine by extending play, and to add more excitement in playing the progressive gaming system.

Actual horse racing has also represented a historic gaming sport. As discussed in Scarne's "New Complete Guide to Gambling" (1974), there are three basic money pools in horse racing: win, place, and show. Wagers can be made as follows: win (the wagered-on horse is first); place (the wagered-on horse places either first or second); and show (the wagered-on horse finishes first, second, or third). In addition, the following wagers may be conventionally made: Quiniela (the wagered-on two horses finish first and second without regard to order); Exacta (the wagered-on two horses finish first and second in the order selected in); Trifecta (the wagered-on three horses finish first, second, and third in the order selected); and Superfecta (the wagered-on four horses finish first, second, third, and fourth in the order selected). Other types of wagers such as daily double, twin double, across the board, and a five-six sweepstake pool can also be made. The above-described bets of Quiniela, Exacta, Trifecta, and Superfecta are termed "exotic bets". Most casinos also have stand-alone casino games with horses usually made of plastic and mounted on a support that moves along a slot in a racetrack environment. A random number generator selects which horses win.

A number of prior horse race casino games are known. U.S. Pat. No. 3,810,627 provides an automated horse race game for use in a casino. U.S. Pat. No. 4,844,462 sets forth an electronic racing game using a microprocessor. U.S. Pat. No. 5,186,460 is a modification of a computerized horse race game wherein energy is reserved to each contestant thereby allowing each player to determine the rate at which the energy is consumed by the horse. U.S. Pat. No. 5,411,258 allows video and audio tracks to be played during the horse race in order to simulate an actual horse race. U.S. Pat. No. 5,564,701 provides a gaming apparatus suitable for races having at least two competing objects (i.e., horses) identified by an associated unique set of identification symbols. The gaming apparatus then generates random sequences of at least one of the symbols associated with the objects. A calculating device in the system then calculates an independent incremental value for each horse to determine independent incremental progression of play. U.S. Pat. No. 5,664,998 combines a plurality of slot machines (or other gaming machines) arranged in a row with a racing display mounted above the machine so as to be visible by each of the players and by spectators. The race display above the machines could be a horse track or an auto race track. Each slot machine is connected to a different horse or car on the track which is advanced along the track by a predetermined amount depending upon the number of coins being played. The horse or car that reaches the finish line first is the winner and the player is awarded a prize.

A need exists to combine the excitement of actual horse racing into the environment of linked gaming machines interconnected to a progressive jackpot controller. A further need exists to adapt other types of races and games into the environment of the casino. A further need exists to adapt a race game into the linked gaming machine environment interconnected to a progressive jackpot controller as a bonus game or as a stand-alone game. A final need exists to provide a progressive game with a guaranteed winner.

SUMMARY OF THE INVENTION

1. Solution to the Problem

The present invention adapts the excitement of actual horse racing, other types of racing, and other game outcomes into the casino environment of linked gaming machines interconnected to a progressive jackpot controller both as a bonus game and as a stand-alone game with a guaranteed win.

2. Summary

The present invention relates to a novel progressive game that can be incorporated either as a bonus game or a stand-alone game in a progressive linked gaming machine environment. While the preferred embodiment relates to a horse derby race game, the method of the present invention can be adapted for any type of race game or any other type of game. The game utilizes a plurality of progressive jackpot pools each associated with a particular game outcome (i.e., such as Quiniela, Exacta, Trifecta and Superfecta in the case of a race derby game). Each progressive jackpot pool is funded through play at the underlying linked game such as a contribution of each wager or through separate wagers. When the game of the present invention initiates such as through a bonus condition or from simply starting the game, a plurality of successive rounds are played. Each round is the play of a game such as a horse race. However, each successive game reduces the number of possible game outcomes such as by reducing the number of horses in each successive horse race. Therefore, with each successive new game round players have a higher probability of winning. The terminating round is reached in which the last game always results in at least one winner through reduction of the possible game outcomes. However, a player (or players) may win in the first or any successive round which would immediately terminate the overall game. Hence, the game always provides at least one winner in a progressive jackpot pool. In the case of joint winners, the progressive jackpot, under the preferred embodiment, is evenly split among the winners. The game is designed so that the player starts each game with a set of tickets wherein each ticket is game outcome. For example, in the case of a horse race, each player receives a set of four tickets: Quiniela, Exacta, Trifecta and Superfecta. In the preferred embodiment, a predetermined number of horses starts the game and the controller randomly selects a grouping of horses for each set of tickets at the start of each round so that each different player has a different grouping of horses. This random selection of horses is preserved throughout the entire play of the game in each game round. In other embodiments, the players can select the horse groupings based upon the available horses. In this environment, it is possible for a player to win more than just one progressive jackpot. For example, in the case of a horse race, should the grouping of horses for the Superfecta win, the player automatically wins the progressive jackpots for the Trifecta, Exacta, and Quiniela.

DESCRIPTION OF DRAWINGS

FIG. 3 sets forth the displayed payoff table of the present invention.

DETAILED DESCRIPTION OF THE INVENTION

1. Overview

Figure 1:
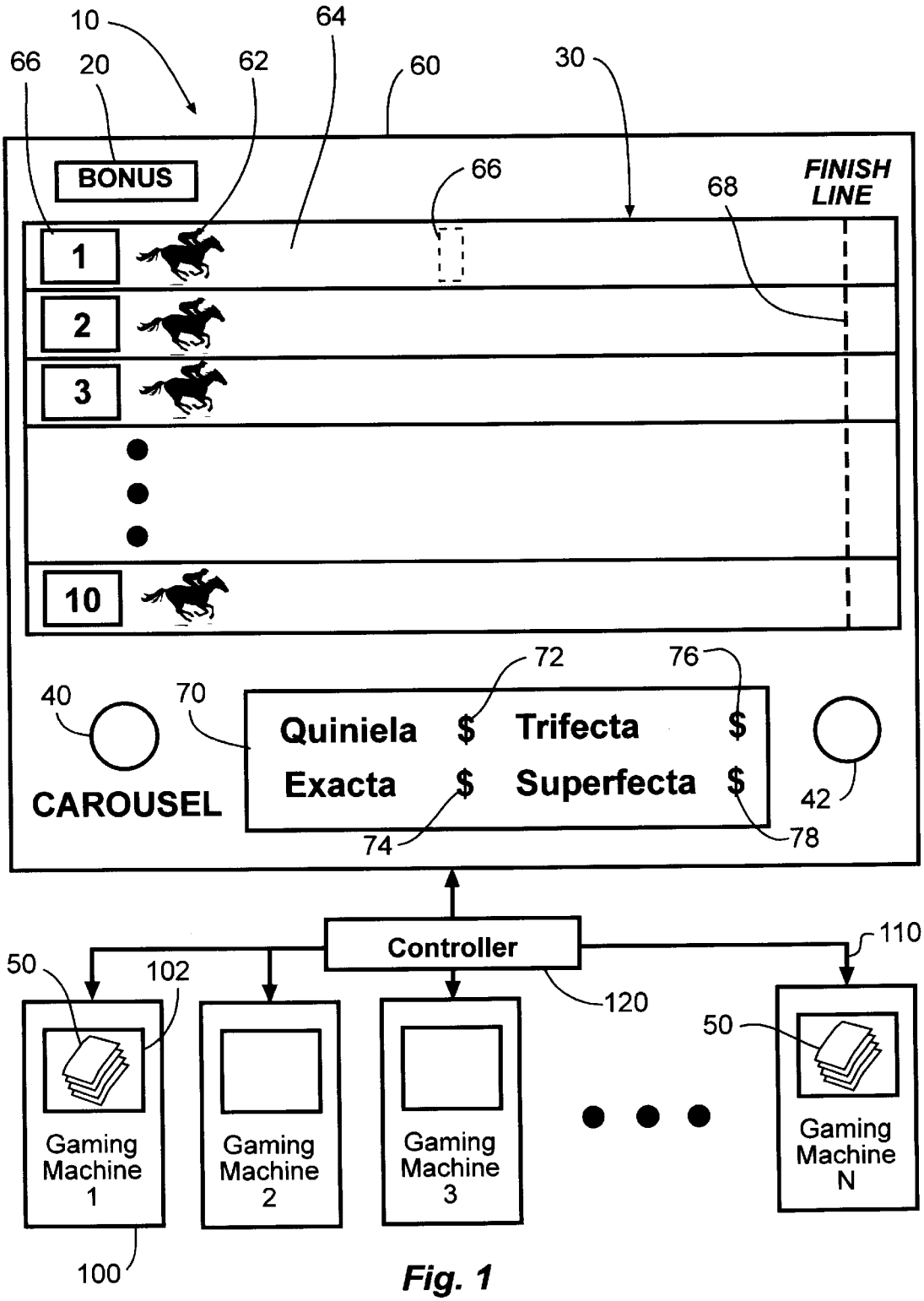
FIG. 1 sets forth the horse derby carousel bonusing system of the present invention.

In a first embodiment of the present invention, the horse derby bonus game 10 of the present invention as shown in FIG. 1 provides considerable excitement for players. Without warning, the special bonus mode 20 triggers. The derby horse race carousel 30 begins to flash while an announcement is made on loudspeakers 40, "Horses at your gates!". A set of Quiniela, Exacta, Trifecta and Superfecta tickets 50 are awarded and displayed at each player's screen 102. The prize pools 72, 74, 76, and 78 for each exotic ticket 40 are clearly shown on display 70. Players see their horses nearing the gates. The starting gun fires! Ten horses leave the gates and they're off!

The animated horse race described above is fast paced and ends quickly. Of ten horses starting, nine make it to the finish line. Players are quickly informed of the final standings on the large screen display 60. However, no tickets 50 match the winning horses this time! Since there are no lucky winners in the first bonus round, the bonus mode remains active! As the main race ends, bonus round two of the sweepstakes bonus race begins, but this time one horse is scratched from the race and new tickets are issued! The odds look better then ever . . . It's obvious that someone is going to win a jackpot! As each successive bonus race starts, one additional horse is scratched resulting in new tickets. The players see that big-ticket jackpots are closer and closer with the number of horses reducing in number! The excitement grows through each bonus round! Then suddenly, a lucky player sweeps the winners board! The bonus game is over.

What has been described is a general overview description of one preferred embodiment of the present invention setting forth a derby horse race carousel bonus game. The teachings of the present invention are not limited to this preferred embodiment. For example, in a variation players can also bet at the start of each bonus round or in another variation players can select the actual horses. Any type of race game can be implemented as a bonus game or stand-alone for a progressive system of linked gaming machines interconnected to a controller 120. In FIG. 1, the underlying gaming machines 100 are linked such as by any suitable network 110 to a controller 120. The nature and design of the controller 120, the network 110, and the linked gaming machines 100 are conventional and well known in the art. The linked gaming machines 100 can comprise any number such as N although in a typical embodiment the number is between 10 and 40.

The race implemented can be a car race, a foot race, or the like. In FIG. 1, a graphical image of the race icon 62 is displayed such as a horse, a car, a human, or any other racing object such as a turtle, rabbit, etc. is displayed in a slot 64 which separates each racing icon 62 from the other racing icon. Each slot 64 has a graphical representation 66 identifying the racing icon 62 and/or the slot 64. Indeed, the racing icon 62 can incorporate the graphical representation 66. The graphical representation 66 may be a number, a letter, a combination of numbers and letters, a color, a combination of numbers, letters, and colors, etc. The slot 64 can simply be a plain slot as shown in FIG. 1 or can include obstacles such as jumps, mud bogs, etc. all of which are not shown. Such an obstacle is shown by dotted lines and identified by reference numeral 66. Finally, a finish line 68 is provided. The racing icons 62 move across the tracks 64 to the finish line 68. Finally, the game need not be a race and, in general, it can be based upon probable game outcomes.

The presentation in FIG. 1 is one of many possible multimedia presentations and the teachings of the present invention are not to be limited to any individual artistic expression.

2. Detailed Description of the Horse Derby Carousel Bonusing Game

The general theme for the horse derby bonus game 10 is that of a horse race with unique betting propositions. Keeping with horse racing tradition, the Quiniela proposition must correctly identify the top two horses, regardless of win order. The Exacta proposition must identify the top two horses in correct order, both win and place. The Trifecta proposition must identify the top three horses in order, that is, win, place and show. The Superfecta proposition must identify the top four horses in order.

For each proposition, a progressive jackpot pool is maintained; therefore, there are four separate jackpots, one each for the Quiniela, Exacta, Trifecta, and Superfecta tickets 50. Each bonus pool accrues money through a percentage contribution of all money wagered on the system. It is conventional in progressive gaming systems to fund the progressive pool from percentage contributions of all money wagered at the gaming machines 100. When any exotic ticket 50 is hit, the corresponding prize pool is awarded to the player, and the bonus mode terminates. However, several other things will also occur. For one, any award hit will "sweep" the board. That is, the player is entitled to a win for their main ticket as well as a win for all smaller valued tickets. Secondly, jackpots are shared by all players hitting the same ticket. For example, assume a player has a set of tickets with payoffs as follows:

TABLE I

| Tickets 50 | Horses 62 | Pool Payoff Value |
|---|---|---|
| Quiniela | 1-5 | $18 |
| Exacta | 1-5 | $32 |
| Trifecta | 1-5-8 | $70 |
| Superfecta | 1-5-8-3 | $585 |

If the outcome of the race is horses in the following order: 1-5-8-2,then the player "sweeps the board" for Trifecta, Exacta, and Quiniela and wins $70+$32+$18=$120. Therefore, it's possible, under the teachings of the present invention, that a single winner for the Trifecta ticket will share the Exacta and Quiniela jackpots with another player. In the above example, if one other player has a set of tickets as follows:

TABLE II

| Tickets 50 | Horses 62 | Pool Payoff Value |
|---|---|---|
| Quiniela | 1-5 | $18 |
| Exacta | 1-5 | $32 |
| Trifecta | 1-5-7 | $70 |
| Superfecta | 1-5-7-9 | $585 |

Then, the two players evenly share in the Quiniela and Exacta payoffs. Hence, the player of Table I receives: $70+½(32)+½($18)=$95 and the player of Table II receives: ½($32)+½($18)=$25.

What is described above, in general terms, is a game wherein a number of progressive jackpot pools (i.e., Quiniela, Exacta, Trifecta and Superfecta) are provided for a corresponding number of possible game outcomes (i.e., the actual horses winning position at the finish line) When the wagered outcomes (i.e., the tickets with the random groups of horses) match the actual game outcomes (i.e., the winning horses), a payoff(s) is made from the corresponding pool(s).

The sweepstakes bonus mode is triggered like a conventional MYSTERY™ jackpot system from Mikohn Gaming Corporation. In this case, the smallest jackpot pool, the Quiniela ticket pool, is used as the MYSTERY™ jackpot amount. Once bonus contributions to the Quiniela pool are large enough, a MYSTERY™ event triggers the overall system into the sweepstakes bonus mode. Once the bonus mode triggers, the system guarantees that at least one eligible player will win at least one jackpot. This is accomplished by hosting a series of tournament races that begins with an initial starting line-up of horses. In each race, fair standings are determined and any winning ticket is identified. If a winner is found, the sweepstakes bonus mode is over. If there are no winners, the bonus mode continues into the next derby game cycle. Once again, a tournament race is started, but with one less horse then the previous round. Again, standings are determined and compared against all outstanding tickets. This process of hosting tournament or bonus rounds repeats, if necessary, until only two horses remain, in which case the Quiniela ticket must be hit and shared by all eligible players.

As stated previously, winners receive the primary ticket's jackpot as well as all smaller jackpots. Therefore, winners always "sweep" the board of all lesser jackpot pools. This is due to the fact that the system 10 issues to each player a series of tickets corresponding to a race outcome with the same set of horses. For example, of the four horses chosen for a Superfecta ticket, the top three horses of the ticket comprise the Trifecta ticket. Similarly, the Exacta ticket is the top two horses of the Trifecta ticket and the Quiniela ticket is the same two horses of the Exacta ticket, but they can place in any order. This means that a player hitting the Trifecta will "sweep the board" because they also hit the Exacta and Quiniela tickets (same horses). Note, however, that such players must also share any jackpots that other players also win.

3. Bonus Game Outcome Analysis

During normal game play on the derby carousel 30, all jackpot pools 360 continue to increase in value. When the bonus mode is entered and a ticket 50 is hit, that pool and all lesser pools are awarded. A suitable reset (sometimes referred to conventionally as a seed) amount is replaced into each awarded pool except for the Quiniela. The reset amount is funded by a conventional hidden jackpot mechanism and is discussed later. For all larger pools not awarded, they continue to grow in value and will be offered in the next bonus mode. The Quiniela pool is kept secret and is reset back to zero. The bonus mode is triggered once the Quiniela pool reaches a secret value within the MYSTERY™ jackpot limits set by the operator. One of the pools is used as the trigger for the bonus mode, and, in the preferred embodiment, this pool is the Quiniela pool (i.e., the pool having the highest probability of being won).

The effect of the above strategy is to grow the Exacta, Trifecta and Superfecta pools to significantly larger values when not hit. In general, the Quiniela requires that the player have two horses will win and place, but in either order. The Exacta ticket requires that the two horses are specified as to which horse will win, and which horse will place. Winning the Exacta is somewhat harder then the Quiniela, since the exact order of the horses must be correct. In general, this will be twice as hard as the Quiniela win. The Trifecta is even harder since the exact order of three horses must be specified. Depending on the total number of horses, this is significantly harder to hit then the Exacta, thus this bonus pool is expected to grow large. For example, if 10 horses are used in the race, then hitting the Trifecta should be about 8 times harder then hitting the Exacta. Following this line of reasoning, the Superfecta should be about 7 times harder then the Trifecta. These odds for the first bonus round are summarized for a race with 10 horses:

TABLE III

| Tickets 50 | Odds of Hitting with 10 horses |
|---|---|
| Quiniela | 1 in 45 |
| Exacta | 1 in 90 |
| Trifecta | 1 in 720 |
| Superfecta | 1 in 5040 |

Another theme of the bonus mode of the present invention is that if no player hits a ticket, the number of horses to race in the next bonus round will decrease by one. This makes all tickets 50 easier to hit in the next bonus round. In fact, the odds of hitting the Quiniela will increase since the number of combinations of two horses is less in 9 horses total. Likewise, the chance of hitting the Exacta will improve the same as the Quiniela. Moreover, the chances of hitting the other two tickets will improve even more significantly. To illustrate this, the odds for subsequent bonus rounds are:

TABLE IV

| | Bonus Round | | | |
|---|---|---|---|---|
| Tickets 50 | 2 Odds w/9 horses | 3 Odds w/8 horses | 4 Odds w/7 horses | 5 Odds w/6 horses |
| Quiniela | 1 in 36 | 1 in 28 | 1 in 21 | 1 in 15 |
| Exacta | 1 in 72 | 1 in 56 | 1 in 42 | 1 in 30 |
| Trifecta | 1 in 504 | 1 in 336 | 1 in 210 | 1 in 120 |
| Superfecta | 1 in 3024 | 1 in 1680 | 1 in 840 | 1 in 360 |

The above table shows that while the Exacta is always twice as hard as the Quiniela, the Trifecta and Superfecta do not remain fixed with respect to the Quiniela; in fact, they get progressively easier to hit. To offset this effect, the Trifecta and Superfecta are not offered when the number of horses falls below a preset number of bonus rounds, say 6 or so. The dropping of the Superfecta can occur at an earlier round that the dropping of the Trifecta or they can occur at the same round. However, the Quiniela and Exacta will continue to be offered until the number of horses falls to 2, where at least one player is guaranteed to win one or both of these pool amounts. (As a note, any player winning the Exacta will also take the Quiniela.)

In practice and for many variations of the teachings of the present invention, actual values for the bonus payoffs are determined through computer simulation. Furthermore, the known "statistical" values can be controlled by altering the minimum number of horses allowed for each ticket, and to a lesser degree, by altering the starting number of horses in the first bonus race. However, the process described above always assumes that a progressive jackpot is awarded to at least one eligible machine in the bonus mode (i.e., a guaranteed win).

4. Method of Operation

The following paragraphs describe each aspect of the bonusing system to help clarify its overall operation.

a. The Bonus Mode

Figure 4:
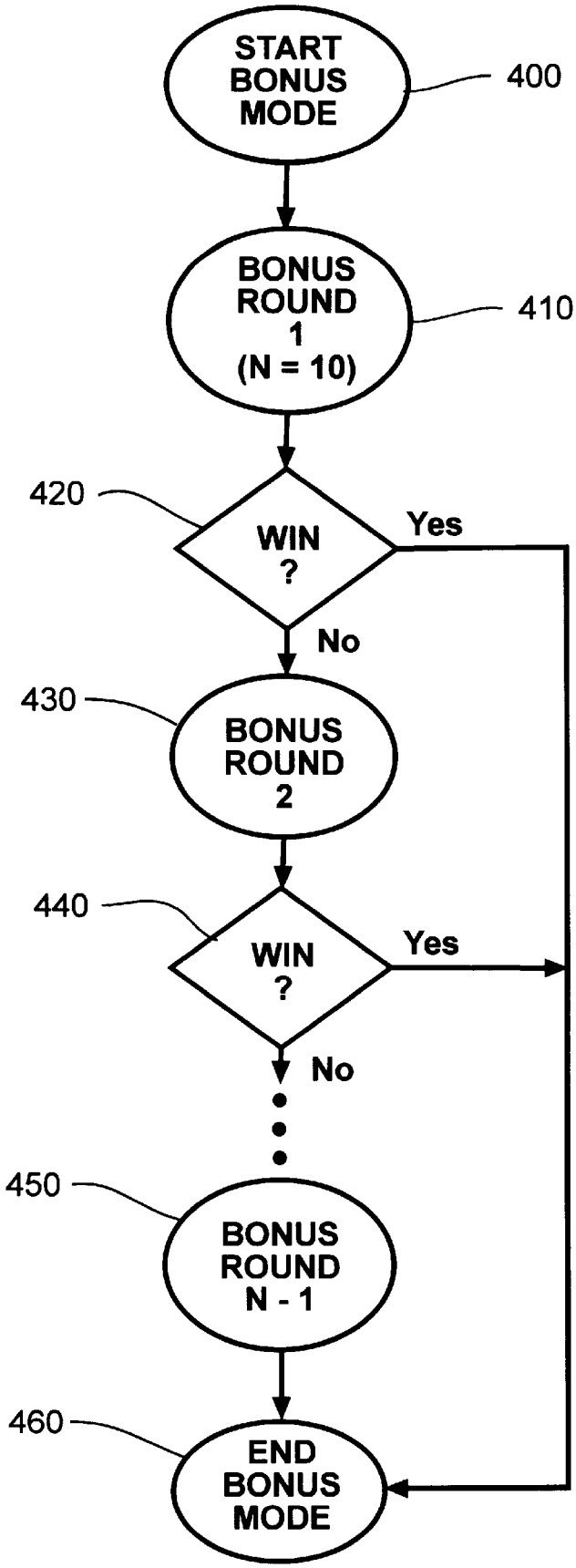
FIG. 4 sets forth the bonus round flow chart of the present invention.

As stated earlier, a bonus mode consists of a number of bonus rounds. In fact, anywhere between one and N−1 bonus rounds (410, 430, 450) will be hosted, as shown in FIG. 4, where N is the starting number of horses in the first round. For example, if 10 horses are started in bonus round one, it is possible to have anywhere between 1 and 9 bonus rounds within one bonus mode. A bonus mode is active when the horse race carousel is in the bonus state 400, where the system 10 is issuing bonus tickets at the end of each main game, and hosting a sweepstakes race to determine a lucky winner. The bonus mode process continues until at least one player wins (420, 440, 450).

Within the bonus mode, each bonus round will last for approximately 15 seconds. This time period will co-exist with the wager period of the derby game, but wagering may also be processed in some variations on the primary game during the bonus game as well. The bonus race can also be shortened if 15 seconds is too long. Any approximate time may be utilized and while constant for each bonus round in the present invention, is not so limited.

To summarize the operation of the bonus mode of the present invention and with reference to FIG. 4, the bonus mode starts in stage 400 with all gaming machines 100 that are eligible. When the bonus mode starts 400, this occurs as previously discussed which in the preferred embodiment is when the Quiniela pool reaches a trigger amount. At that time, those gaming machines 100 that are being played are eligible. Eligibility can be based on any conventional event such as: game being played, a predetermined time period before or after game played, amount of wager, etc. Once the bonus mode has started in stage 400, then for each bonus round which is bonus round 410, 430 and 450, a set of tickets 50 based only on the horses for that round are delivered to each gaming machine 100 that is eligible. Delivery of the sweepstake tickets 50 is discussed in the next section. The race for bonus round occurs and the horses are placed according to when they cross the finish line 68. At that point, the controller 120 determines in a win determination stage 420 (440) whether an eligible gaming machine has won. If a gaming machine 100 has any tickets in the set 50 that correspond to a win, then stage 460 is entered. If not, the next bonus round is entered into.

b. Choosing Sweepstake Tickets

Sweepstake tickets (i.e. the Quiniela, Exacta, Trifecta and Superfecta) 50 with horses randomly chosen by the bonus controller 120 are issued as a set to each eligible gaming machine 100 (i.e., to a player) prior to the start of each bonus round. There is no preference given to any particular horse or ticket—the selection is random. The horses are only chosen from the available horses at the starting gate before each round. Furthermore, the tickets 50 sent to each player form a "ticket set" which will contain the same groups of horses. For example, the Quiniela and Exacta both have the same horses. The Trifecta will contain the same two horses as the Quiniela and Exacta for the top two places, and the Superfecta will contain the same top three horses as the Trifecta. This is illustrated in Tables I and II, above. This guarantees that a player hitting any given ticket will also win all other tickets below that ticket (i.e., sweep the board). This guarantees that the system can be regulated using the Quiniela pool only as explained later. Multiple ticket sets 50 can be distributed to players placing wagers that are multiples or more than the minimum wager; in this case, each ticket set has horses chosen by random and therefore horses between ticket sets 50 are not necessarily related.

In FIG. 3, the screen display appearing at the gaming machine 100 that is eligible to participate in the bonus mode 400 of the present invention is shown. Here, in column 300, the selected horses for Quiniela, Exacta, Trifecta, and Superfecta are shown. If the player has wagered two times the minimum wager in the gaming machine prior to the bonus mode starting, then in column 310 the horses selected for the "second buy-in" are illustrated. Finally, if the player has wagered three times the minimum wager, the "third buy-in" 320 is shown. It is to be expressly understood that some casino games have four times, five times, etc. the minimum wager and that suitable additional columns could be entered wherein additional horses are selected.

At this point, the player sitting at the eligible gaming machine 100 as shown in a display at the machine in FIG. 3 has horses randomly selected in three sets of tickets 50 and set forth in columns 300, 310, and 320 for the horse race for the next bonus round. The identity of the bonus round is shown prominently in area 330. The race is then run and the results are displayed in area 340. In the example of FIG. 3, and assuming the player had wagered three times the minimum wager, then as shown in column 320, the player is awarded the Quiniela for the third buy-in resulting in an award of twenty-four credits. (i.e., the round one race results are horses number three, seven, two, and nine as shown in area 340.) The Quiniela award is based upon horses three and seven finishing in any order. In the event any other eligible gaming machine has the same Quiniela value of seven, three, then the award of twenty-four credits is proportionately shared.

c. Triggering the Bonus Mode

The bonus mode is triggered using a conventional MYSTERY™ jackpot arrangement. When the bonus pool of the Quiniela rises between two pre-set dollar values, a low and high limit, and meets or exceeds a secret value, the bonus mode will trigger. During the bonus mode, at least one player is guaranteed to win. That win will always deplete the Quiniela ticket pool and possibly other ticket pools. Once this occurs, the bonus mode is declared complete and the system must accrue additional money in order to re-enter the bonus mode. This occurs once enough money has been deposited back into the Quiniela ticket bonus pool.

Hidden values are kept for all ticket pools except the Quiniela in order to ensure they are replenished beyond a zero reset value. This keeps players interested and eligible for the Tournament Sweepstakes bonus jackpots. In the preferred embodiment, the Quiniela is reset at zero, and the low MYSTERY™ jackpot range also starts at zero. Furthermore, in the preferred embodiment the Quiniela jackpot value is not displayed until the bonus mode has triggered. In this way, the system can ensure up-most secrecy of the MYSTERY™ jackpot value as well as where it might hit. Furthermore, starting the lower MYSTERY™ range where the reset value begins ensures the possibility of back to back bonus modes.

d. Running The Race

The race is run with all horses 62 that line up at the starting gate. The first round starts with a pre-set number of horses 62 determined prior to bonus mode start-up. Each additional bonus round is run with one less horse. In this manner, at least one player will be guaranteed to win. During the race, the animated horses 62 race in slots 64 across the screen 30, some passing others, some lagging behind. The final placement of all horses 62 is shown on the graphics board. However, all final placements are determined by the bonus controller in a completely random manner. In other words, there are no favorites, and each horse 62 is as likely to win as any other horse 62. The race resembles a "stake race" in which all horses 62 are equally handicapped.

e. Paying the Bonus Pools

For the Quiniela tickets, if a player's top two horses win and place, the player is awarded the entire Quiniela pool. If more then one player wins and places, they split the Quiniela prize pool. These rules apply for all other pools. For the Exacta ticket, a player has the top two horses of the race in order. For the Trifecta ticket, three horses must be in proper order, and for the Superfecta ticket, four horses must be in proper order. If two players win the same ticket, they split that jackpot and also split any lower jackpots with all total winners of each specific jackpot. If no one wins, the bonus round continues after the next game, but with one less horse from the previous round. Players understand that odds of hitting a jackpot improve in each successive tournament round. Someone must win a race to cancel the repeating bonus rounds which cancels the bonus mode.

f. Financing the Jackpot Pools

These are three preferred methods for financing the jackpot pools of the Tournament Sweepstakes bonus game. Each method has its strengths and weaknesses. While each method is described below, it is to be expressly understood that other methods could be used to fund the separate pools.

Method No. 1—Eligibility Bet Threshold: In this method, the jackpot pools are financed by taking a percentage contribution from all eligible wagers. This method requires that the player wager a minimum number of coins to become eligible for the bonus mode. The minimum number of coins required is adjusted to an optimum value by the casino operator. This value is typically greater then the average wager of the game without the bonus system. The main advantage of this method is that it serves to increase the average wager of the system. The main disadvantage of this method is that money will only accrue into the jackpot pools through wagers that meet the minimum eligibility amount. Any wagers not meeting or exceeding this amount will not contribute towards the jackpot pools. To create additional profitability, the increase in revenue due to increased wagers must more then offset any decrease in game hold.

As already described, Method No. 1 wagering requires a minimum wager on the gaming device to be eligible for the bonus mode when it triggers. By wagering at least this amount, the player is eligible for the bonus mode and receives at least one set 50 of horse race tickets. By wagering two times this amount, the player is eligible to receive two sets 50 of horse race tickets. In general, players can be eligible for as many ticket sets 50 as they are wagering minimum threshold increments. This provides additional incentives for high rollers to wager more money, not less. Thus this feature becomes an important element of the system. This feature may also have a limit of say four sets 50 of tickets to reduce display complexity requirements. In Method No. 1, no contributions are made to jackpot pools except for contributions on even multiples of the minimum wager (e.g., two times the minimum wager).

The following statistics constitute an example and are assumed estimates of typical performance measures of a bonus game 10 of the present invention. These estimates assume a $0.25 (i.e., a quarter) denomination, a decent casino site, and a hold percentage of 8%.

Minimum and Maximum daily handle estimates are:

Low=$625

High=$3000

Average=$1560 (based on $125/day handle at 8% hold)

Average wager size is relatively small, and is between 5 to 8 coins per game. An average of 6 quarters per game is typical, or average wager amount of $1.50.

Average number of players is assumed to be: 10 players in a 12 position game carousel.

The high limit for the bonus trigger is $10, and the low limit for Quiniela trigger is zero dollars.

The availability of computer simulations allows the Tournament Sweepstakes bonus game to be easily evaluated in terms of performance measures. For example, the following increment settings are assumed for the bonus parameters:

TABLE V

| Jackpot Pool | Percentage Contribution |
|---|---|
| Quiniela | 1.4% |
| Exacta | 1.0% |
| Trifecta | 1.0% |
| Superfecta | .6% |
| Total | 4.0% |

While the above table shows different percentage contributions for each jackpot pool, it is to be expressly understood that these are examples only and that the percentage contributions can be the same, each different from the other, some the same, etc.

Using ten bonus horses for the first bonus round starting line-up, and offering the Trifecta when there is at least 6 horses and offering the Superfecta when there is at least 8 horses, the following average jackpot pools and average total pays are shown for each ticket:

TABLE VI

| Jackpot Pool | Average Jackpot Value | Average Total Paid | Coins Paid |
|---|---|---|---|
| Quiniela | $5 | $4.44 | 18 |
| Exacta | $6.35 | $10.46 | 42 |
| Trifecta | $39.90 | $49.39 | 200 |
| Superfecta | $251.72 | $301.46 | 1200 |

The "average total paid" for Quiniela is less than the "average jackpot value" since the jackpot may be shared with others. The "average total paid" for the Exacta, Trifecta, and Superfecta are higher than the "average jackpot paid" since they can sweep the board to include the lower jackpots.

Because of the Quiniela bonus trigger range settings, on average it takes $5.00 of contribution to the Quiniela pool to trigger the bonus mode. The average handle required would therefore be:

$5.00/1.4%=$357.14

Therefore, it would take each of 10 players wagering $35.71 to trigger the bonus mode on average. If the average bet of $1.50 is doubled to $3.00, the bonus mode will trigger on average every 12 games. If the game cycle time is 2 minutes, then a sweepstakes bonus mode would occur every 24 minutes on average. The bonus mode will last for 6 minutes and take three rounds to complete on average according to simulations.

These averages work acceptably well in the above example. Further, the dynamics of the system are also strong. For one thing, bonus modes can occur back to back, or they can take longer then expected, building up jackpot pools in the process. The longest time under the example conditions is 48 minutes between bonus modes. Recall that each bonus mode includes a number of bonus rounds. The number of bonus rounds in a bonus mode can be as many as 9. For example, bonus modes having 6 or more rounds occur over 12% of the time. The hits on the Trifecta or better pool are equally exciting, with this occurring over 5% of the time. Of course, every bonus mode has at least one winner, and all winners sweep the board for potentially larger payoffs. This is why the average total paid for the Exacta is much higher then its jackpot value because of the sweep of the Quiniela.

Another interesting note is the number of multiple winners since these players split the available pools. This happens about 16% of the time. In most of these cases, there are multiple winners in the Quiniela and Exacta tickets.

The bonus game of the present invention can have its award and operating parameters adjusted based on casino requirements in order to optimize specific performance parameters. This section uses the example numbers above with modifications to one or more parameters to illustrate their effects.

a. EXAMPLE #1

The values of the Superfecta or Trifecta jackpot can vary. Increasing the value means they get hit less frequently. Suppose the operator desires to increase the value of the largest award, the Superfecta. The solution is straightforward. If the Superfecta jackpot is only offered in the first round (i.e. 10 horses, one opportunity), and the average take for this ticket increases to about $920. According to simulations, an average pay table is then:

TABLE VII

Effect of making Superfecta available in first round only

| Jackpot Pool | Average Total Paid | Coins Paid |
|---|---|---|
| Quiniela | $4.44 | 18 |
| Exacta | $10.46 | 42 |
| Trifecta | $49.39 | 200 |
| Superfecta | $929.34 | 3720 |

b. EXAMPLE #2

As another example of the flexibility of the bonus system of the present invention, assume that the player's average wager is high, such as $5.00. In this case, the bonus mode might be adjusted to trigger at a higher average Quiniela value, such as $12.50 (by setting the trigger ranges between $0 and $25). It would then take a total handle of $892.85 to trigger the bonus mode on average if 1.4% contribution is set. This means ten players need to wager an average of $89.28 each. At $5.00 per bet, this would take approximately 18 games on average, and assuming 2 minutes per game cycle, the bonus mode would occur every 36 minutes. The bonus mode would last 6 minutes on average, or about 16% of the time. The following pay-table would emerge assuming the Trifecta is offered with 6 or more horses, and the Superfecta offered with 9 or more horses.

TABLE VIII

Effect of adjusting jackpots for heavy bettors

| Jackpot Pool | Average Total Paid | Coins Paid |
|---|---|---|
| Quiniela | $11.08 | 44 |
| Exacta | $26.11 | 104 |
| Trifecta | $122.22 | 488 |
| Superfecta | $1045.12 | 4180 |

As a third point, altering the percentage contributions going to each pool also controls the frequency of bonus awards, however, average pay tables remain the same.

Method No. 2—Side Proposition Wager: This alternate embodiment method of financing the bonus system requires that players wager a separate coin for the purpose of the bonus mode only. In other words, a separate side wager is required for eligibility into the bonus game, and the side wager can fully fund the jackpot pools 100%. The main advantage of this system is to create the highest rate of contributions for bonus pools. Another advantage is that the side wager proposition does not impact the payback percentage of the primary game. The disadvantage of this method is that players must be willing to wager on a bonus they have yet to see, or wait for a bonus that may never occur at all. Additional profitability is based upon a percentage contribution of all bonus wagers going directly to the house. In this system, only a single set 50 of tickets need to be issued in the simplest case. This differs somewhat from the requirement to give multiple tickets in Methods No. 1 and No. 3.

Method No. 3—Any Coin Eligibility: As in Method No. 1, jackpot pools are financed by taking a percentage contribution from all wagers, however there is no minimum wager amount. This method does not require any special wagering instructions to the player. It is a "free bonus" offered for simply playing. The main objective of this form of financing is to drive more players to the game. Another advantage is the bonus takes advantage of contributions from all players. The main disadvantage is that it does not create any additional incentives to increase wager size. This form of financing bonuses affects a given game par sheet by increasing the payback to the player. To create more profitability for the operator, the increase in player participation must more then offset any decrease in game hold.

In this system, it is necessary to grant multiple sets of tickets in proportion to wager size. The proportion factor can be a given number of coins, similar to the minimum wager size concept, but the first coin wagered in this system always guarantees eligibility for a single set of tickets in the bonus mode. Additional sets of tickets will cost an additional fixed amount.

Because of the nature of the race game of the present invention, and because of the nature of the derby game player, Methods No. 1 and No. 2 are preferred embodiments for the system 10 of the present invention.

5. System Illustrations

Various screen layouts are discussed in this section to further clarify the operation of the bonus game 10 of the present invention.

a. Bonus Ticket Screen Presentation

The linked gaming machine system 10 must be modified to display the screen of FIG. 3 during the bonus race mode in each gaming machine 100. The provision of such a screen 300 is conventional.

In FIG. 3, the screen initially appears to the player with the bonus round number of the race and a blank ticket set. Shortly thereafter, the horses for each ticket set are displayed in the areas allocated under the "First Buy-in". If the player wagered (in the game just ended) more then two times the minimum buy-in amount, then a second set of tickets 50 will also be displayed. Three sets of tickets 50 are displayed if a player wagers more then three times the minimum buy-in amount. In general, N number of ticket sets can be issued for N multiples of buy-in wagered at each terminal. The practical limitation for N is the screen space required. This screen can be displayed on a separate display instead of relying on the main screen at the underlying game 100.

Once the bonus race ends, the placement of the top four horses are shown at the lower section 340 of the screen 300 reserved for the race results. For each player, if any of the tickets match the race outcome, then that award will be highlighted 350 as well as all lower awards (since the player sweeps the board). The jackpot pools corresponding to the winning tickets will be debited and the awards (and any splits) made to the players credit meter.

b. Tournament Race Board

The tournament race board is a large format screen 30 that is centrally mounted for all players to see, thus there is only one Tournament Race Board. An illustration of the race board is shown in FIG. 2.

Figure 2:
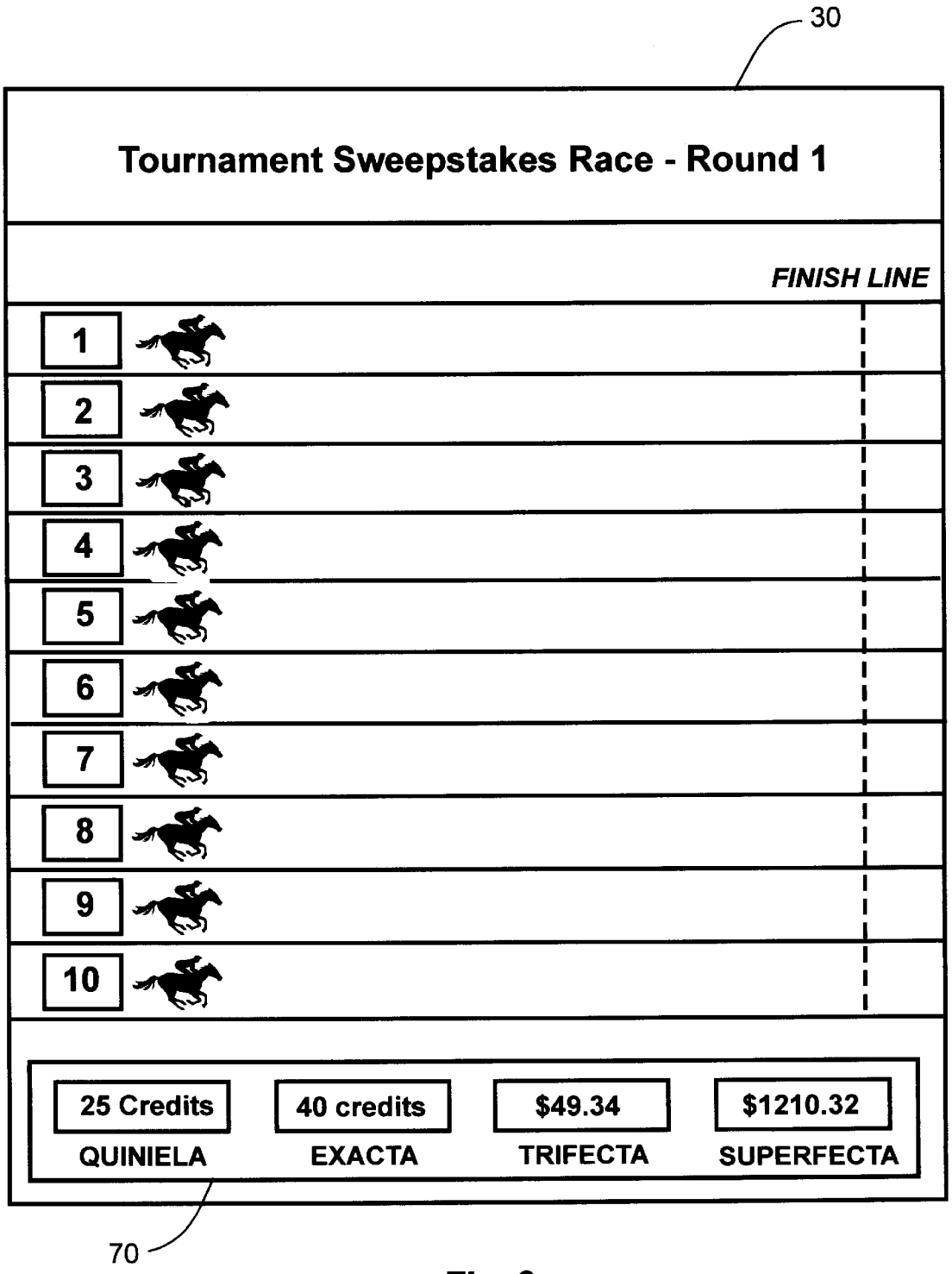
FIG. 2 sets forth the horse derby bonus display showing the displayed horses and the displayed racing track.

As shown in FIG. 2, ten horses are at the starting gates (starting gates not shown). The value of the bonus jackpots are clearly shown at the bottom 70 of the figure. Once the race is over, the region where the jackpot pools are displayed will be replaced (or displayed in a separate area) by the winning order of all horses.

During the race, one horse is chosen to fall. This creates interest in the next round as this horse is then scratched from the next race (if there is no current winner).

6. Stand-Alone Game

Figure 5:
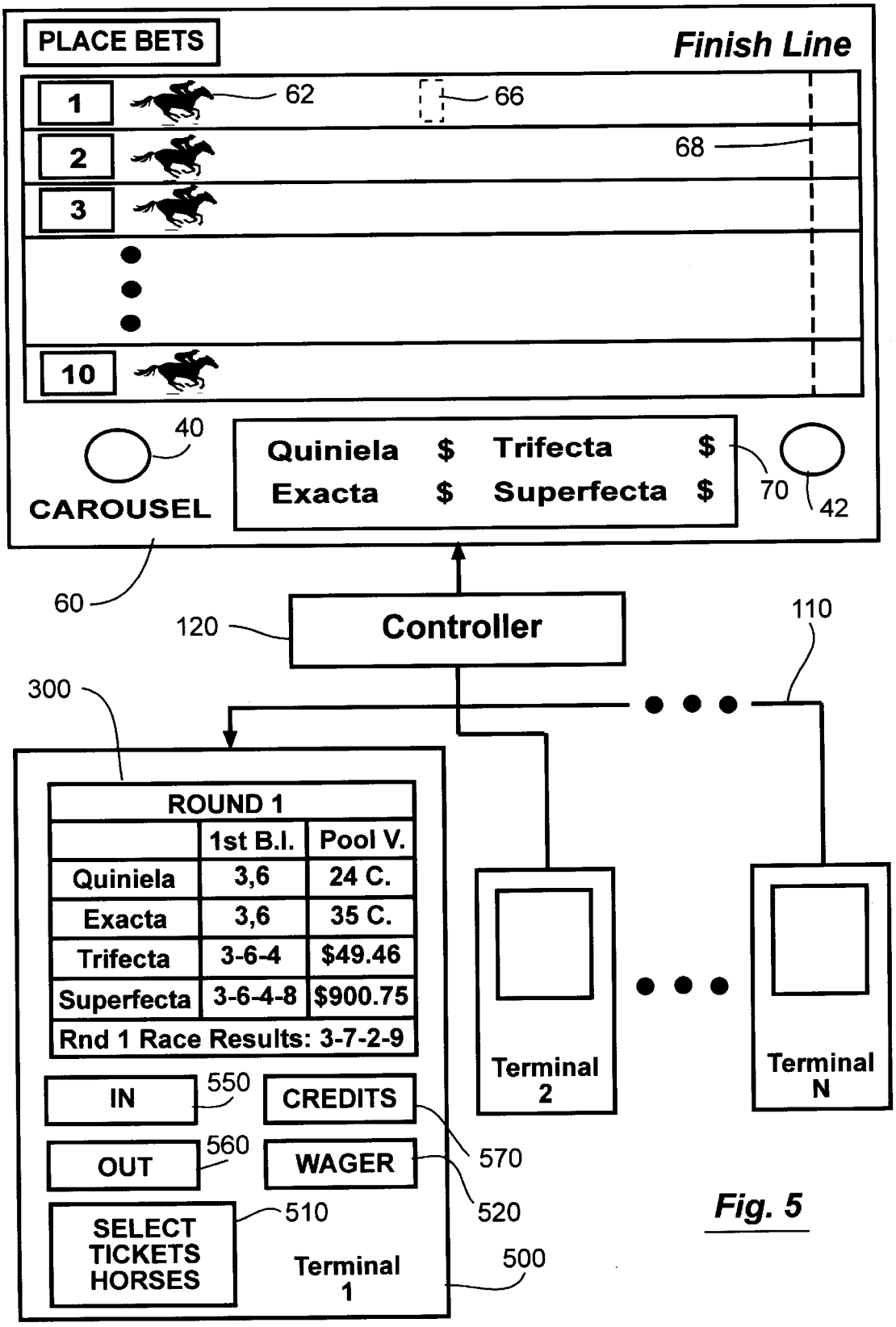
FIG. 5 sets forth the horse derby carousel stand-alone system of the present invention.
Figure 6:
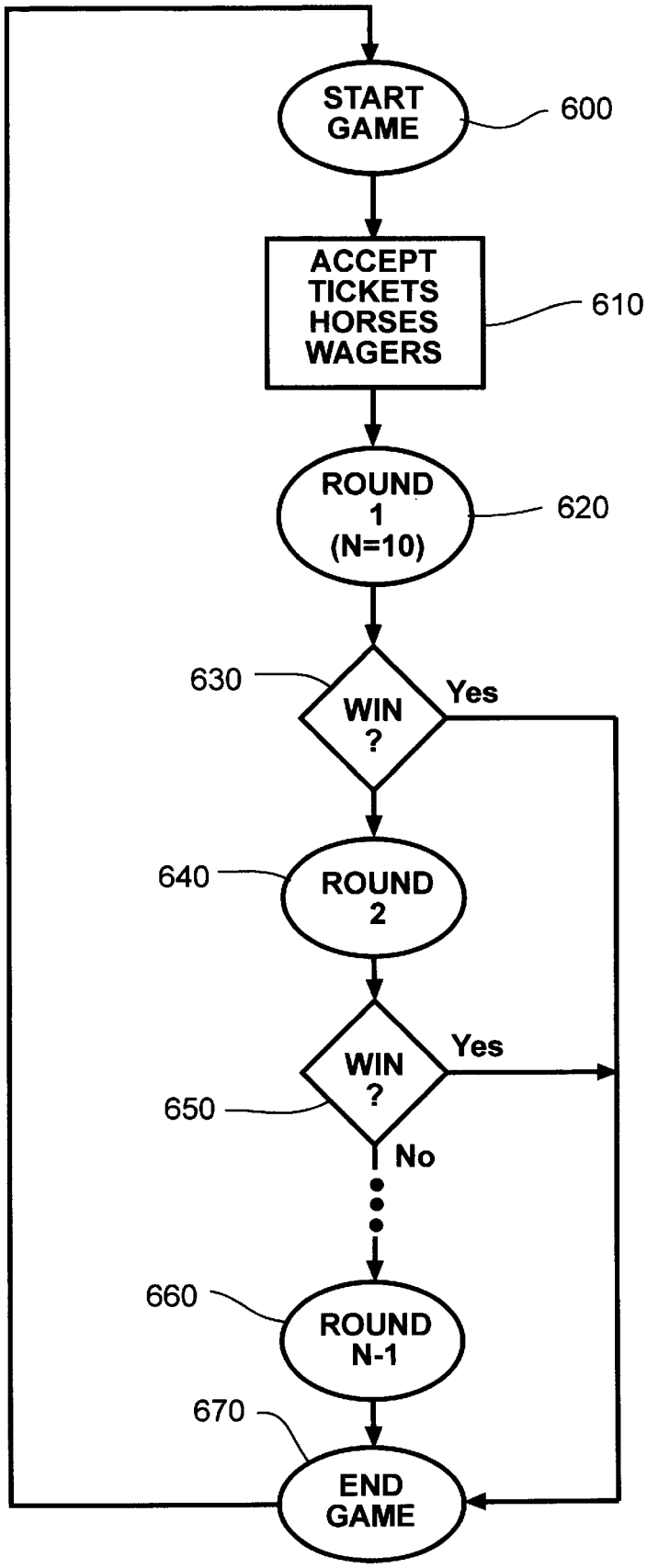
FIG. 6 sets forth the stand-alone flow chart for the system of FIG. 5.

In FIGS. 5 and 6, the method of operating a linked progressive jackpot race game is set forth. A plurality of betting terminals 500 are interconnected over a network 110 to a controller 120 which in turn is connected to the display 60. The betting terminals 500 are different from the gaming machines 100 in FIG. 1 but the network 110 and the controller 120 can be the same although programmed to interact with the betting terminals in a different fashion. Each betting terminal has the screen 300. In reference to FIG. 6, the controller 120 starts the game in stage 600. Controller 120 provides a suitable multimedia announcement such as a display 510 (along with any suitable audio announcements in speakers 40) which requires any player sitting at the betting terminals 500 to select the tickets and which horses for the upcoming race.

The selection occurs in a suitable input device 510. It is to be expressly understood that any of a wide variety of inputs could be utilized. For example, separate buttons for the tickets such as buttons labeled Quiniela, Exacta, Trifecta, and Superfecta could be provided in area 510. A player would select which or any combination of ticket buttons to activate. Upon activation the button could be conventionally lit. Or, the Quiniela, Exacta, Trifecta and Superfecta areas on screen 650 could be simply touched in a touch screen environment by the player and backlit to show selection. Horses then can be selected based upon the tickets activated. Again, in area 510, buttons corresponding to the horses or race icons 62 and suitably labeled such as 1 through 10 could be provided. Again, when those buttons are activated they are back lit to inform the player. The player then places the wagers in area 520 in a conventional fashion. For example, a fixed wager could be made to play the entire set 50 of tickets or different wagers could be made for each different ticket. In the one embodiment, only one wager is made to play the entire set of tickets. This simplifies the input terminal by eliminating buttons or activations for separate tickets in the set since the player is required to play the entire set of tickets with the single wager. Hence, in this one embodiment, only the horses are selected and the player must select four horses. With reference to FIG. 3, in other embodiments, the player may buy in for more sets of tickets. This could be accomplished by selecting multiples of the minimum wager in area 520 in a conventional fashion. It is well known in the casino industry how to provide multiples of a minimum wager in a gaming machine.

Hence, in the stand-alone version of the present invention, many variations are possible under the teachings hereof. The player can select individual tickets: Quiniela, Exacta, Trifecta and Superfecta or be required to wager on the entire set. The player can select which horses for which ticket or select the horses for the entire set of tickets. The set of tickets are not limited to Quiniela, Exacta, Trifecta and Superfecta and can be any sub-combination thereof or additional tickets. The wager 520 can be on the entire set or can purchase additional sets 50 of tickets. The wager can also be on individual tickets. In any event, in stage 610 of FIG. 6 the controller provides a suitable time period in which all players sitting at terminals 510 can select the tickets and/or the horses and make the wagers 520.

In the preferred embodiment, the player does not select the tickets nor the horses, rather, as in the preferred embodiment for the bonus game, the controller 120 delivers a complete set 50 of tickets with four randomly selected horses to the display 300 in terminal 500 for each round (i.e., each race). This speeds the game up by having the selection automatically occur.

The controllers 120 in stage 610 provides a suitable multimedia announcement to all players at the terminals 510. The controller 120 terminates stage 610 with a suitable multimedia announcement such as "wagers are in and the race is set to go." Stage 620 is now entered which is the first race round which occurs as previously discussed for the bonus version of the present invention. The horses are raced across the slots 64 to the finish line 68 to win in a random order as determined in the controller 120 according to a conventional random number generator or software package. How to randomly select winning horses based upon a random number generator is well known. The controller 120 in stage 630 determines any terminals 510 having tickets in the set 50 that win and have horses corresponding to the finished order. This occurs in the same fashion as previously discussed for the bonus game. If a win occurs, the game is over and stage 670 is entered. If there are no winners, the second round 640 is entered. The race is rerun with a new set of tickets and a determination of winners are made in stage 650. If there are winners, stage 670 is entered and the game is over. This process repeats for a fixed number of rounds when stage 660 is entered. As previously discussed, a horse is eliminated in each round. Which horse is eliminated can be randomly determined or simply the bottom horse (e.g., first horse 10, then horse 9 are eliminated). As fully discussed above, a winner will result either in a winning stage such as stage 630 or 650 or at round 660. As before, should any terminal 510 have the same winning ticket as any other terminal, the pool jackpot for that ticket is split evenly.

In conventional fashion, each terminal 500 has conventional devices for receiving in monetary units 550 for paying out monetary units 560 for displaying current credits 570, and the like. How to input cash, credit, debits, etc. is well known in the casino industry. How to cash out 560 is well known, and how to display credits 570 are well known.

In the embodiment of FIGS. 5 and 6, the wagers 520 themselves fund the individual jackpot pools of Quiniela, Exacta, Trifecta and Superfecta. A portion of each wager (or in the case of separate wagers, the actual wagers themselves) fund the jackpot pools.

As fully discussed before, the Superfecta jackpot pool is the most rarely hit and, therefore, continuously grows whereas the Quiniela is the most frequently hit. This adds excitement to the game and to the players participating at the terminals.

In a variation on this method, in each new round 620, 640, and 660, the players at terminals 500 place additional wagers 520. The additional wagers qualifies the players to continue in the round.

7. Application to Other Games

While the above preferred embodiments relate to race games such as horse races, it is to be understood that the teachings are not so limited. For example, the teachings can be adapted for a lottery game. For example, a lottery with ten bouncing numbered balls (i.e., numbered 1–10) would comprise the first round of the overall game of the present invention. Each successive round results in the removal of one numbered ball (e.g., the second round ball numbered 10 is removed). The tickets, in this adaptation, would be tickets for four correct numbers, three correct numbers, and two correct numbers. All of which can be in any order (i.e., combination). The tickets for four and three correct numbers after a number of rounds could be eliminated. Hence, for each round, a new set of tickets are issued which are randomly selected by the controller for each player and then lottery balls are withdrawn to complete that game round. Note that each set of tickets use only balls available in each successive round. Any winners would cause the overall game to quit and, if there are no winners, then one ball would be removed and the process repeated until either a win occurs in a successive bonus round or there is a guaranteed winner at the end bonus round.

Indeed, in each of the above examples, a plurality of progressive jackpot pools are provided with one pool for each game ticket. The term "ticket" as used herein generally means a jackpot game outcome. Hence the four separate tickets of Quiniela, Exacta, Trifecta, and Superfecta are four separate game outcomes which are ordered from most probable to least probable. At the start of the common game, all possible game outcomes are maximized (i.e., the maximum number of horses, the maximum number of balls, etc.).

However, in each successive game round, the possible game outcomes are reduced (i.e., the number of horses or balls are reduced for the next game) so that the probability of a player winning increases. Not only are possible game outcomes reduced, but in the preferred embodiment the lowest probable jackpot game outcomes are eliminated (e.g., the Superfecta and Trifecta tickets in the race horse derby variation). In the preferred embodiment, the jackpot game outcomes are such that when a player wins a jackpot game outcome having a lower probability of winning, the player sweeps the board and wins the progressive jackpots for all jackpot game outcomes having a higher probability under it (e.g., winning the Superfecta sweeps the Trifecta, Exacta, and Quiniela). The wagered game outcome (e.g., the actual horses wagered on) for each jackpot game outcome (i.e., ticket) before the start of each game round can be randomly selected by the method of the present invention or can be selected by the players. At least one player is guaranteed a win before or at the final game round. The progressive jackpot pools are funded from wagers placed at underlying gaming machines, or through separate wagers before the common game starts or with the start of each individual game.

Finally, the number of game outcomes are reduced by reducing the number of race icons (or balls, etc.) so as to increase the likelihood of winning so that the last round is always a winner. In Keno, the same goal can be achieved by increasing the number, for example, of balls.

The above disclosure sets forth a number of embodiments of the present invention. Those skilled in this art will however appreciate that other arrangements or embodiments, not precisely set forth, could be practiced under the teachings of the present invention.

I claim:

1. A casino race bonus game for an underlying set of eligible gaming machines in a system of linked gaming machines comprising the steps of:

starting the casino race bonus game, playing a plurality of bonus rounds in the casino race bonus game with a number of displayed race icons in response to the step of starting, each bonus round comprising the steps of:

(a) displaying a set of randomly selected sweepstakes tickets at each eligible gaming machine;

(b) racing the number of displayed race icons on a displayed race track to a random finish;

(c) awarding each eligible gaming machine having at least one displayed sweepstakes ticket corresponding to the random finish of the displayed race icons and ending the bonus game, (d) when no award occurs in aforesaid step, reducing the number of displayed race icons by at least one and repeating steps (a) through (c).

2. The casino race bonus game of claim 1 wherein the race icon is a horse icon.

3. The casino race bonus game of claim 2 wherein the set of sweepstakes tickets in the first bonus round comprise:

Quiniela, Exacta, Trifecta, and Superfecta for four randomly selected race icons in the number of displayed race icons.

4. The casino race bonus game of claim 3 wherein the set of sweepstakes tickets only comprise the Quiniela and Exacta after a certain number of bonus rounds have occurred.

5. The casino race bonus game of claim 3 further comprising the steps of:

providing a separate pool for Quiniela, Exacta, Trifecta, and Superfecta, funding each separate pool from wagers placed at the linked gaming machines.

6. The casino race bonus game of claim 5 further comprising the step of using the Quiniela pool value in comparison to a randomly generated value as a bonus game trigger to start the casino race bonus game.

7. The casino race bonus game of claim 1 having the plurality of bonus rounds equal to nine.

8. The casino race bonus game of claim 7 having the number of race icons equal to ten in the first bonus round.

9. The casino race bonus game of claim 1 wherein another set of sweepstakes tickets is randomly displayed when additional wagering occurs in the eligible gaming machine prior to the start of the casino race bonus game.

10. The casino race bonus game of claim 1 wherein an additional set of sweepstakes tickets is randomly displayed for each multiple of a minimum wager in the eligible gaming machine prior to the start of the casino race bonus game.

11. The casino race bonus game of claim 1 wherein the step of awarding further comprises the step of providing a pro-rata share of a payoff to each eligible gaming machine.

12. A casino race bonus game for an underlying set of eligible gaming machines in a system of linked gaming machines comprising the steps of:

starting the casino race bonus game, funding a plurality of jackpot pools from wagers made in the linked gaming machines, each of the plurality of jackpot pools corresponding to a race outcome, playing a plurality of bonus rounds in the casino race bonus game with a set number of displayed race icons in response to the step of starting, each bonus round comprising the steps of:

(a) displaying a set of randomly selected tickets at each eligible gaming machine, each of said tickets corresponding to a race outcome;

(b) racing the number of displayed race icons on a displayed race track to a random finish;

(c) awarding each eligible gaming machine for each displayed ticket winning in the random finish of the displayed race icons, debiting each jackpot pool in accordance with the award for the winning ticket, and ending the bonus game, (d) when no award occurs in aforesaid step, reducing the number of displayed race icons by at least one and repeating steps (a) through (c).

13. The casino race bonus game of claim 12 further comprising the step of randomly selecting the reduced number of displayed race icons from the set number of displayed race icons.

14. The casino race bonus game of claim 12 wherein the step of funding uses a predetermined percentage of the wagers.

15. The casino race bonus game of claim 12 wherein the step of awarding includes the step of evenly splitting the award from a jackpot pool among all eligible gaming machines having the same winning ticket.

16. The casino race bonus game of claim 12 wherein the step of displaying a set of randomly selected tickets includes selecting a common set of race icons such that each ticket includes the same race icons for each higher probability race outcome.

17. The casino race bonus game of claim 16 wherein the step of awarding includes paying awards from all higher probability jackpot pools having the common set of race icons.

18. A casino horse race bonus game for an underlying set of gaming machines linked to a controller comprising the steps of:

starting the casino horse race bonus game in the controller in response to a bonus game trigger for eligible gaming machines, playing a set maximum number of bonus rounds in the casino horse race bonus game with a number of displayed horses, each bonus round comprising the steps of:

(a) displaying at each eligible gaming machine a different set of sweepstakes tickets randomly selected in the controller;

(b) racing the number of displayed horses on a displayed race track to a random finish as determined in the controller;

(c) awarding each eligible gaming machine having at least one displayed sweepstakes ticket corresponding to the random finish of the displayed horses and ending the casino horse race bonus game, (d) when no award occurs in aforesaid step, reducing the number of displayed horses by at least one and repeating steps (a) through (c).

19. The casino horse race bonus game of claim 18 wherein the set of sweepstakes tickets in the first bonus round comprise:

Quiniela, Exacta, Trifecta, and Superfecta for four randomly selected horses in the number of displayed horses.

20. The casino horse race bonus game of claim 19 wherein the set of sweepstakes tickets only comprise the Quiniela and Exacta after a certain number of bonus rounds have occurred.

21. The casino horse race bonus game of claim 19 further comprising the steps of:

providing a separate pool for Quiniela, Exacta, Trifecta, and Superfecta, funding each separate pool from wagers placed at the underlying set of gaming machines.

22. The casino horse race bonus game of claim 21 further comprising the step of using the Quiniela pool value in comparison to a randomly generated value as the bonus game trigger.

23. The casino horse race bonus game of claim 18 having a set number of bonus rounds equal to nine.

24. The casino horse race bonus game of claim 18 having the number of horses equal to ten in the first bonus round.

25. The casino horse race bonus game of claim 18 wherein another set of sweepstakes tickets is randomly displayed when additional wagering occurs in the eligible gaming machine.

26. The casino horse race bonus game of claim 18 wherein an additional set of sweepstakes tickets is randomly displayed for each multiple of a minimum wager in the eligible gaming machine.

27. The casino horse race bonus game of claim 18 wherein the step of awarding further comprises the step of providing a pro-rata share of a payoff to each eligible gaming machine.

28. A casino horse race bonus game for eligible gaming machines in an underlying set of gaming machines linked to a controller comprising the steps of:

providing a separate pool for Quiniela, Exacta, Trifecta, and Superfecta race outcomes, funding each separate pool from wagers placed at the underlying set of gaming machines, using the value of one of the separate pools in comparison to a randomly generated value as the bonus game trigger, starting the casino horse race bonus game in the controller in response to a bonus game trigger for eligible gaming machines, playing a set maximum number of bonus rounds in the casino horse race bonus game with a number of displayed horses, each bonus round comprising the steps of:

(a) displaying at each eligible gaming machine a set of sweepstakes tickets randomly selected in the controller; the set of sweepstakes tickets in the first bonus round comprising: Quiniela, Exacta, Trifecta, and Superfecta for four randomly selected horses in the number of displayed horses;

(b) racing the number of displayed horses on a displayed race track to a random finish as determined in the controller;

(c) awarding each eligible gaming machine having at least one displayed sweepstakes ticket corresponding to the random finish of the displayed horses and ending the casino horse race bonus game.

29. The method of claim 28 further comprising the step of:

when no award occurs in step (c), reducing the number of displayed horses by at least one, after a first predetermined number of bonus rounds eliminating the Superfecta ticket, after a second predetermined number of bonus rounds eliminating the Trifecta ticket, and repeating steps (a) through (c).

30. A method of operating a common game on a linked progressive jackpot system having a plurality of betting terminals on which players place wagers, said method comprising the steps of:

providing a plurality of jackpot game outcomes, providing a plurality of progressive jackpot pools funded from the wagers, each of the plurality of progressive jackpot pools associated with one jackpot game outcome, the plurality of jackpot game outcomes arranged in order of most probable to least probable, starting the common game with all possible game outcomes maximized, playing a plurality of individual games in response to the step of starting with each successive individual game having fewer possible game outcomes, issuing a set of wagered game outcomes to each player prior to each successive individual game played, paying from the progressive jackpot pools when the wagered game outcomes match the individual game outcomes.

31. The method of claim 30 wherein the process of selecting said game outcome wagers includes the random selection of game outcomes from the set of all possible game outcomes of each successive individual game.

32. The method of claim 30 wherein the process of selecting said set of game outcome wagers includes at least one game outcome wager associated with a progressive jackpot.

33. The method of claim 30 wherein the process of selecting said set of game outcome wagers is such that each successive lower probability game outcome wager includes the outcomes of all other higher probability game outcomes such that matching a particular game outcome involves matching the game outcomes for any and all higher probability game outcomes for each set of game outcome wagers.

34. The method of claim 30 wherein the process of paying any said progressive jackpot when said game outcome wager matches the associated individual game outcome, and wherein the process of paying the progressive jackpot may include splitting the progressive jackpot evenly among all players having an identical game outcome wager associated with each individual game outcome.

35. The method of claim 30 wherein each progressive pool is incremented through a predetermined percentage contribution of all wagers placed for each said individual game played on each said betting terminal.

36. The method of claim 30 wherein the process of re-establishing the starting of the common game when any said individual game wager matches the results of an individual game.

* * * * *